United States Patent [19]

Lambert et al.

[11] Patent Number: 4,509,931

[45] Date of Patent: Apr. 9, 1985

[54] POWERED TOY VEHICLE WITH PIVOTABLE AXLE MOUNTING

[75] Inventors: Gérard L. Lambert; Gary M. Saffer, both of Torrance, Calif.

[73] Assignee: Mattel, Inc., Hawthorne, Calif.

[21] Appl. No.: 455,686

[22] Filed: Jan. 5, 1983

[51] Int. Cl.[3] ..... A63H 29/20; A63H 17/26

[52] U.S. Cl. ..... 446/462; 446/466; 446/469

[58] Field of Search ..... 46/201, 206, 208, 209, 46/221; 446/462, 466, 469

[56] References Cited

U.S. PATENT DOCUMENTS

| | | | |
|---|---|---|---|
| 368,499 | 8/1887 | Feichmann | 46/206 |
| 1,529,832 | 3/1925 | Dengler | 46/208 |
| 1,538,205 | 5/1925 | Munday | 46/209 |
| 2,996,840 | 8/1961 | Goss | 46/206 X |
| 3,570,175 | 3/1971 | Angier | 46/209 X |
| 3,635,304 | 1/1972 | Hills | 46/221 |
| 3,650,067 | 3/1972 | Greenwood | 46/209 |

*Primary Examiner*—F. Barry Shay

*Attorney, Agent, or Firm*—Ronald M. Goldman; James G. O'Neill

[57] ABSTRACT

A four-wheel-drive toy vehicle (10) is powered by a flywheel (74) coupled to a drive shaft (116) drivingly connected to a front axle (123) and a rear axle (124) rotatably mounted to a front journal box (126) and a rear journal box (128), respectively. Each journal box (126), (128) is rotatably coupled to the drive shaft (116) and a vehicle chassis (34).

4 Claims, 4 Drawing Figures

POWERED TOY VEHICLE WITH PIVOTABLE AXLE MOUNTING

DESCRIPTION

1. Technical Field

The present invention relates to powered toy vehicles and particularly to flywheel powered toy vehicles having articulated axle mountings.

For many years, children have been entertained with powered toy vehicles. Such vehicles usually have a chassis, motion-imparting apparatus mounted in the chassis, an output member connected to the motion-imparting apparatus, an axle, at least one ground-engaging wheel coupled to the axle for rotation thereby, and means for coupling the axle to the output member for rotation thereby. The motion-imparting apparatus is sometimes in the form of a flywheel mounted in the chassis on a vertical axis so that the flywheel rotates in a horizontal plane.

2. Background Art

The prior art, U.S. Pat. Nos. 2,873,553; 3,570,175 and 3,698,129 each provides a toy vehicle having a flywheel mounted on a vertical axis so that the flywheel rotates in a horizontal plane. Energy from the flywheel is then transmitted to the rear wheel of the toy vehicle through suitable gears, frictional couplings or the like.

DISCLOSURE OF INVENTION

In accordance with the present invention, a powered toy vehicle is provided with at least one articulated axle mounting. The vehicle may be powered with a motion-imparting apparatus taking the form of a flywheel mounted in the vehicle on a vertical axis so that the flywheel rotates in a horizontal plane.

The play value of the vehicle is enhanced by coupling at least one wheel-carrying axle and a drive shaft to the vehicle chassis in a manner such that the axle is free to pivot about the drive shaft on an axis normal to the major axis of the axle. This articulated wheel suspension keeps the axle gears engaged with the drive shaft gears without using universal joints and differential gearing. The axles are carried by yokes or journal boxes. Axle springs coact with these yokes to assure that the vehicle body remains upright and that all four wheels remain on the ground when individual wheels negotiate large bumps forming rough terrain.

The vehicle may also be set on a downhill course, terminating in a level course at the bottom of a hill. This causes the flywheel to precess, making the vehicle body lean forwardly. Sometimes the body will lean to such an extent that a four-wheel-drive vehicle will go up on its front wheels. The vehicle may also be made to do what is referred to as a "side wheelie" by revving the flywheel up and setting the vehicle on either its left two wheels or its right two wheels. Additionally, the vehicle may be set on its rear wheels with the rear bumper on the ground and the vehicle will go around in circles on its rear wheels.

BRIEF DESCRIPTION OF DRAWINGS

The details of the present invention will be described in connection with the accompanying drawings, in which.

BEST MODE FOR CARRYING OUT THE INVENTION

Figure 1:
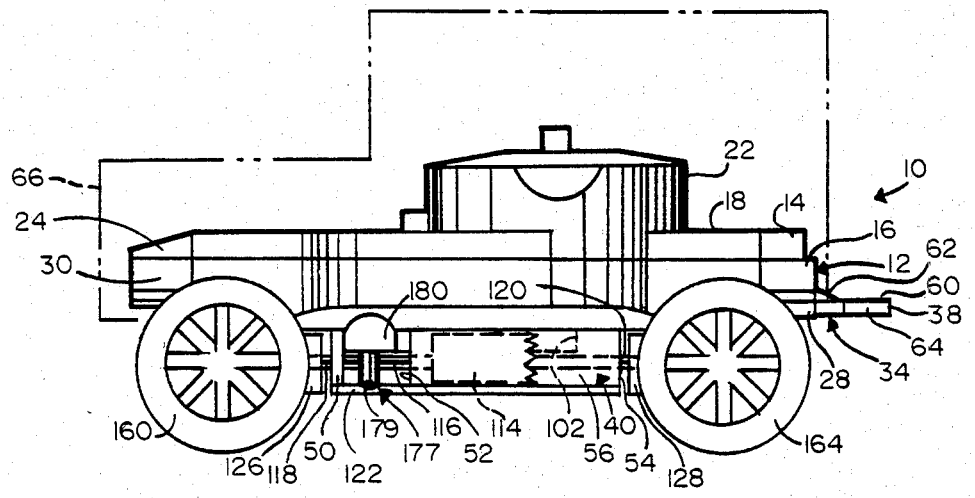
FIG. 1 is a view in side elevation with the vehicle body shown schematically.
Figure 2:
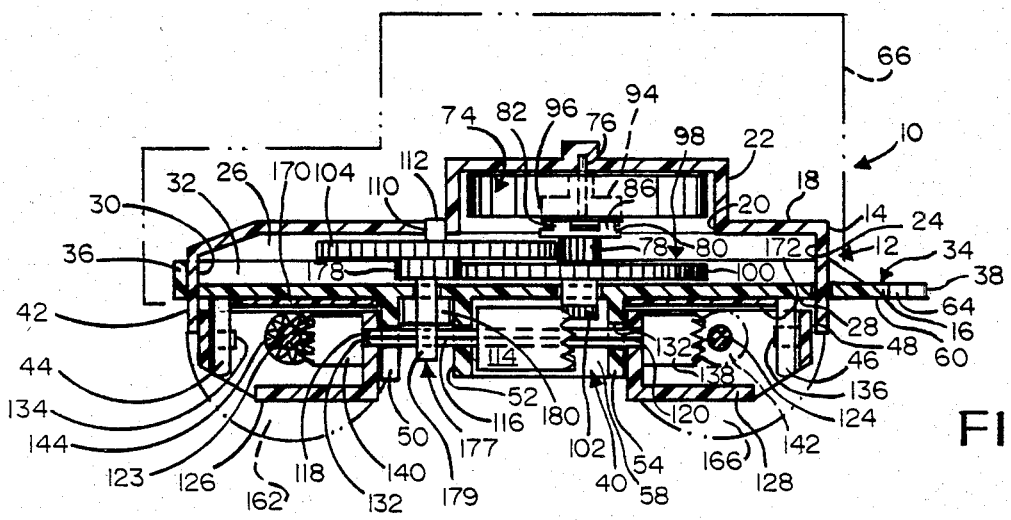
FIG. 2 is a view similar to FIG. 1 with portions of the vehicle shown in cross-section.

Referring again to the drawings, and more particularly to FIGS. 1 and 2, a powered toy vehicle constituting of a presently-preferred embodiment of the invention, generally designated 10, includes a housing 12 having an upper housing half 14 and a lower housing half 16. Upper housing half 14 may be molded as a one-piece unit from a suitable polymeric material and includes a topwall 18 having an opening 20 surmounted by a dome 22. The housing half 14 also includes an encompassing sidewall 24 and an open bottom 26.

Figure 3:
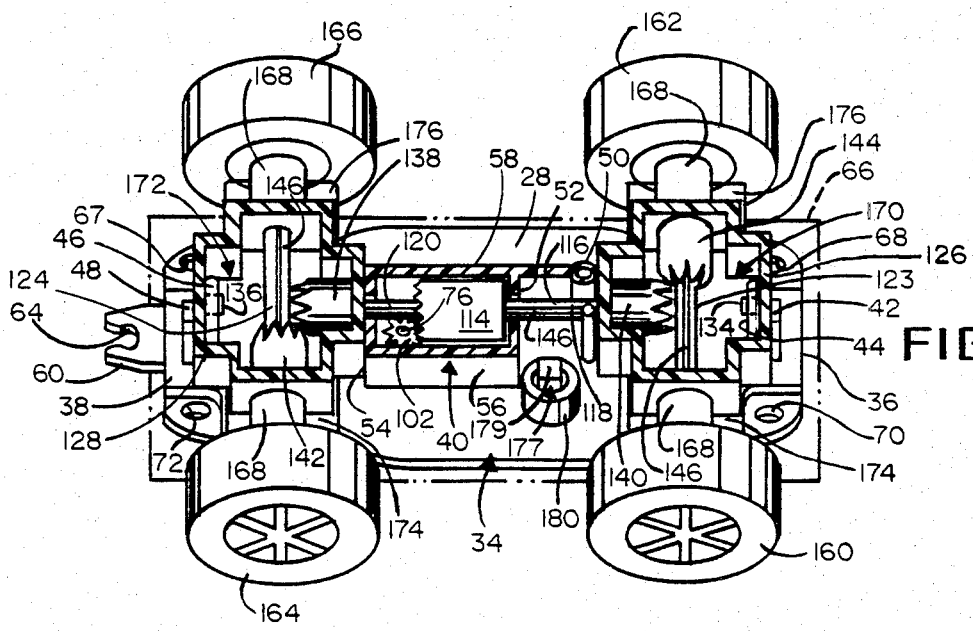
FIG. 3 is a bottom view with portions of the chassis cut away to show internal construction.

Referring now to FIGS. 1–3, the lower housing half 16 includes a bottom wall 28, an encompassing sidewall 30 and an open top 32. Bottom wall 28 serves as the platform portion of a chassis 34 having a front end 36, a rear end 38, a depending gear box 40, a pair of front, depending brackets 42, 44 and a pair of rear depending brackets 46, 48. Gear box 40 includes a front wall 50, an intermediate partition 52, a rear wall 54, a left side wall 56 and a right side wall 58. Chassis 34 also includes a rearwardly-extending tongue 60 and a pair of suitable reinforcing gusset plates, like the one shown at 62. Tongue 60 may be used to pull other vehicles behind vehicle 10 and is provided with a keyhole-type aperture 64 for connecting other vehicles thereto. Vehicle 10 may also include a suitable body, as indicated schematically at 66, which may be connected to chassis 34 by suitable screws (not shown) passing through apertures 67, 68, 70 and 72 provided in chassis 34 (FIG. 3).

Figure 4:
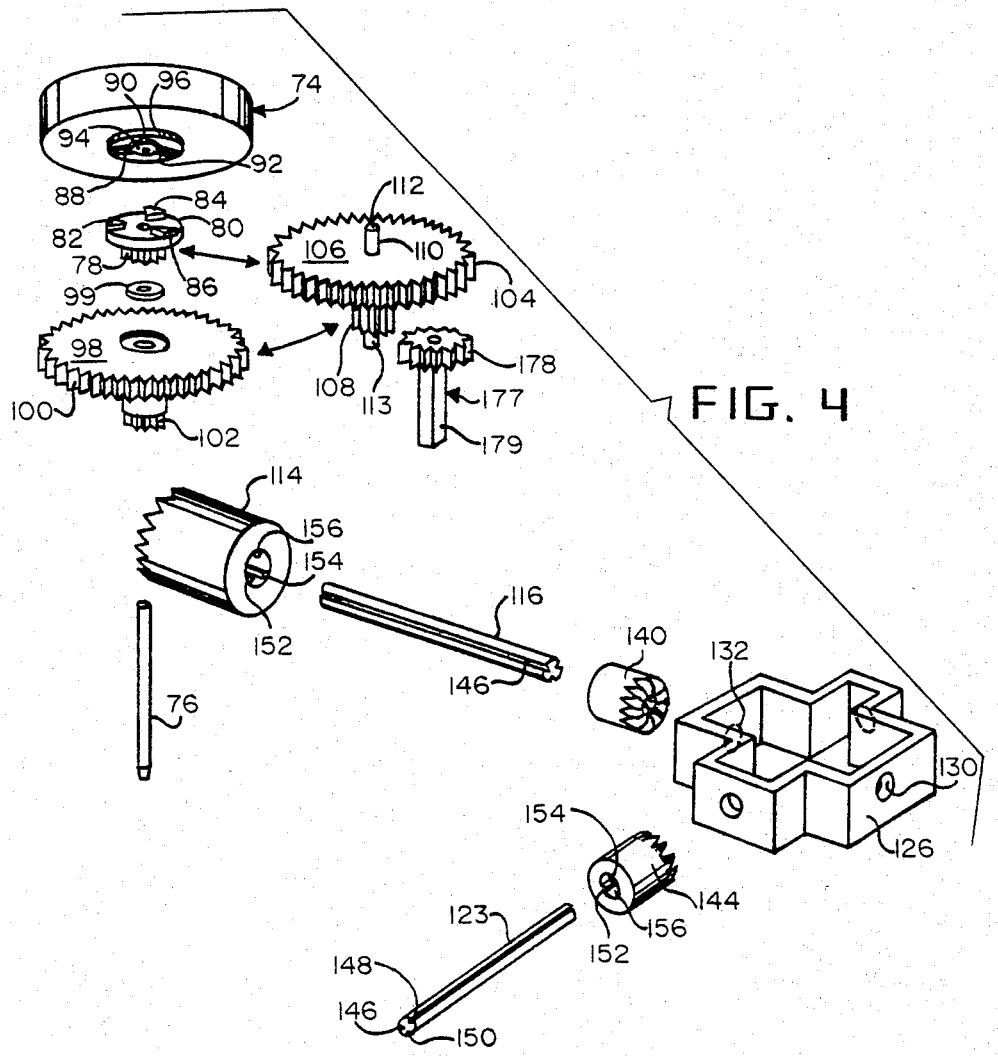
FIG. 4 is an enlarged, exploded perspective view showing the motion-imparting apparatus and associated parts for transmitting power to one axle.

Referring to FIGS. 1–4, vehicle 10 may be powered by a suitable motion-imparting apparatus which is shown herein for purposes of illustration, but not of limitation, as comprising a flywheel 74 mounted in the dome portion 22 of upper housing half 14 by a vertical spindle 76, whereby flywheel 74 will rotate in a horizontal plane. Flywheel 74, which is preferably made of steel, may be coupled to a suitable output member which is shown herein for purposes of illustration, but not of limitation, as comprising a pinion gear 78 (FIGS. 2 and 4). Pinion gear 78 may be molded from a suitable material, such as a polyamide reinforced with fiberglass, and is formed integrally with a coupling disc 80 which carries three upstanding protuberances 82, 84, 86 adapted to engage a set of arms 88, 90, 92 provided on a second coupling member 94 which may be molded from a suitable polymeric material and which is seated in an opening 96 provided in the bottom of flywheel 74. Coupling members 80, 94 prevent flywheel 74 from overloading pinion gear 78 and its associated gear train (to be hereinafter described) because flywheel 74 tends to lift coupling member 94 upwardly with respect to coupling member 80 when such overloading occurs by the protuberances 82, 84, 86 riding over or camming upwardly the arms 88, 90, 92.

Flywheel 74 and pinion gear 78 should be freely rotatable on spindle 76 upon which an output gear 98 is also rotatably mounted beneath a washer 99. Output gear 98 includes a large-diameter gear 100 and a small-diameter pinion gear 102, both of which may be integrally formed from a suitable polymeric material by molding methods well known to those skilled in the art.

Preferably, however, large-diameter gear 100 is molded from a polyamide reinforced with fiberglass and pinion gear 102 is made of steel. Pinion gear 102 may be affixed to gear 100 by employing gear 102 as an insert in the mold when gear 100 is molded. The output from pinion gear 78 is transmitted to the large-diameter portion 104 of an intermediate gear 106 having a small-diameter portion 108 meshing with the large-diameter portion 100 of gear 98. Gear 106, which may be molded from a polyamide reinforced with fiberglass, is rotatably mounted in housing 12 by a suitable shaft 110 having an upper end 112 journalled in top wall 18 and a lower end 113 (FIG. 4) journalled in bottom wall 28.

The output from gear 98 is transmitted to a suitable crown gear 114 meshing with the small-diameter portion 102 of gear 98. Crown gear 114 may be made of steel and is keyed to a drive shaft 116 in a manner to be hereinafter described. Drive shaft 116, which may also be made of steel, includes a front end 118 and a rear end 120. Drive shaft 116 is rotatably mounted in front wall 50, partition 52 and rear wall 54. Drive shaft 116 is held in position in gear box 40 by a closure member 122 (FIG. 1) which may also be used to close the open-bottom portion of gear box 40.

Referring now more in particular to FIGS. 2, 3 and 4, vehicle 10 may also include front and rear axles 123, 124 which may be made of steel and which may be rotatably mounted in front and rear yokes or journal boxes 126, 128, respectively. As shown in FIG. 4 for the journal box 126, each journal box 126, 128 is provided with a front journal bearing 130 and a rear journal bearing 132. The front journal box 126 is pivotably coupled to drive shaft 116 by rear journal bearing 132 and to chassis 34 by a pivot pin 134 journalled in front journal bearing 130 and affixed to rear bracket 44. The rear journal box 128 is pivotably coupled to drive shaft 116 by rear journal bearing 132 and to chassis 34 by a pivot pin 136 journalled in front journal bearing 130 and affixed to bracket 46. When vehicle 10 is assembled, the journal boxes are first mounted to drive shaft 116 and chassis 34. A first bevel gear 138, which may be made of steel, is then keyed to the rear end 120 of drive shaft 116 and a second bevel gear 140, which may be made of steel, is keyed to end 118 of drive shaft 116 in a manner to be hereinafter described. A third bevel gear 142, which may also be made of steel, may then be held in position in journal box 128 while axle 124 is slid into position trapping the third bevel gear into meshing relationship with bevel gear 138. A fourth bevel gear 144, which may also be made of steel, may then be positioned in front journal box 126 and held in position adjacent the second bevel gear 140 while front axle 123 is slid through the fourth bevel gear 44 to its position in front journal box 126.

As best shown for axle 123 in FIG. 4, front axle 123, rear axle 124 and drive shaft 116 are each provided with a plurality of outwardly concave flutings 146, 148, 150 adapted to transmit torque while leaving about 60% of the shaft to serve as a bearing area. Gears 114, 138, 140, 142 and 144 may then be keyed to their associated torque-transmitting members by providing them with internal splines, as shown at 152, 154, 156 for crown gear 114. Each gear is prevented from sliding on its shaft by trapping it between its associated gear and a fixed wall or locating rib (FIG. 3).

Referring now to FIGS. 2, 3 and 4, vehicle 10 may also include a pair of front wheels 160, 162 and a pair of rear wheels 164, 166. Each wheel has an inside hub portion 168 (FIG. 3) which may be internally splined (as shown for gear 114) so that each wheel may be press-fit to its associated axle for keyed rotation thereby.

As best shown on FIGS. 2 and 3, vehicle 10 may also include a front axle spring 170 and a rear axle spring 172. Each spring may be made from a suitable polymeric material having a "springy" nature, such as polyethylene terephthalate. Each spring is suitably secured to chassis 34 by heat sealing or the like, and includes ends 174, 176 each extending to a position under its associated hub 168. Spring ends 174, 176 are useful in keeping wheels 160, 162, 164 and 166 on the ground when vehicle 10 negotiates rough terrain.

Referring again to FIGS. 1–4, flywheel 74 may be brought up to operating speed by a winding gear 177 having an input gear 178 and a square winding shaft 179 both of which may be integrally molded from a suitable polymeric material, such as polyamide reinforced with fiberglass. Winding gear 177 may be rotatably mounted in a hollow boss 180 formed integrally with chassis 34 in a position such that input gear 178 will mesh with small diameter gear portion 108 of intermediate gear 106. Square shaft 179 is adapted to be engaged by a suitable winding mechanism (not shown), such for example, as the winding mechanism shown in copending application Ser. No. 06/524,513, filed Aug. 19, 1983 and assigned to the assignee to the instant application.

Operation of vehicle 10 is believed to be apparent and is briefly summarized at this point. Flywheel 74 may be energized by repeatedly scrubbing wheels 160, 162, 164 and 166 on a suitable surface or by engaging input gear 177 with a suitable winding device while wheels 160, 162, 164, 166 are slightly elevated above the surface upon which vehicle 10 is adapted to travel. Winding gear 177 will then rapidly rotate intermediate gear 106 through input gear 178 and small-diameter gear porion 108 of gear 106. Intermediate gear 106 will then impart rotation to flywheel 74 through large-diameter portion 104, pinion gear 78 and coupling members 80 and 94.

Vehic1e 10 may be lowered onto its running surface and flywheel 74 will drive vehicle 10 through coupling members 80 and 94, pinion gear 78, large-diameter portion 104 and small-diameter portion 108 of intermediate gear 106, large-diameter portion 100 and small-diameter portion 102 of output gear 98, crown gear 114, drive shaft 116, drive shaft output gears 140 and 138 and axle gears 144 and 142, respectively.

While the particular toy vehicle herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims, which form a part of this disclosure.

We claim:

1. In combination with a toy vehicle having a chassis, motion-imparting apparatus mounted in said chassis, said motion-imparting apparatus having an output member, said vehicle including an axle, at least one ground-engaging wheel coupled to said axle for rotation thereby, and means for coupling said axle to said output member for rotation thereby, the improvement which comprises;

means for coupling said axle to said chassis in a manner such that said axle is free to pivot about an axis normal to the major axis of said axle, and wherein said means for coupling said axle to said output member includes a drive shaft rotatably mounted to said chassis normal to said axle, and wherein said means for coupling said axle to said chassis, comprises:

a journal box for rotatably receiving said axle; a first journal bearing pivotably coupling said journal box to said drive shaft intermediate its ends; and a second journal bearing pivotably coupling said journal box to said chassis on an axis coinciding with the major axis of said drive shaft.

2. In combination with a toy vehicle having a chassis, motion-imparting apparatus mounted in said chassis, said motion-imparting apparatus having an output member, said vehicle including an axle, at least one ground-engaging wheel coupled to said axle for rotation thereby, and means for coupling said axle to said output member for rotation thereby, the improvement which comprises:

means for coupling said axle to said chassis in a manner such that said axle is free to pivot about an axis normal to the major axis of said axle wherein said axle is a rear axle having a ground-engaging wheel coupled to each end thereof for rotation thereby, wherein said combination includes a front axle having a ground-engaging wheel coupled to each end thereof for rotation thereby, wherein said combination includes means for coupling said front axle to said output member for rotation thereby;

means for coupling said front axle to said chassis in a manner such that said front axle is free to pivot about an axis normal to the major axis of said front axle;

and wherein said means for coupling said rear axle to said output member and said means for coupling said front axle to said output member include a unitary drive shaft rotatably mounted to said chassis normal to and between said rear and front axles, and wherein said means for coupling said rear axle to said chassis and said means for coupling said front axle to said chassis, comprise:

a first journal box for rotatably receiving said rear axle;

a first journal bearing pivotably coupling said first journal box to said drive shaft adjacent one end thereof;

a second journal bearing pivotably coupling said first journal box to said chassis on an axis coinciding with the major axis of said drive shaft;

a second journal box for rotatably receiving said front axle;

a third journal bearing pivotably coupling said second journal box to said drive shaft adjacent the other end thereof; and a fourth journal bearing pivotably coupling said second journal box to said chassis on an axis coinciding with the major axis of said drive shaft.

3. A toy vehicle comprising:

a chassis having a front end and a rear end;

a motion-imparting apparatus mounted in said chassis for powering said vehicle;

a pinion gear coupled to said motion-imparting apparatus for receiving the output therefrom;

a drive shaft rotatably mounted in said chassis;

a crown gear coupled to said drive shaft in meshing relationship with said pinion gear;

a first bevel gear coupled to said drive shaft;

a journal box having a front wall, a rear wall, a right sidewall and a left sidewall;

a journal bearing provided in each of said walls on said journal box;

an axle having a right end and a left end, said axle being rotatably mounted in said journal box with said right end of said axle adjacent said right journal bearing and said left end of said axle adjacent said left journal bearing, one of said front and rear journal bearings being rotatably mounted on said drive shaft intermediate said crown gear and said first bevel gear and the other of said front and rear journal bearings being rotatably coupled to one end of said chassis;

a second bevel gear coupled to said axle in meshing relationship with said first bevel gear for receiving an output from said drive shaft; and a ground-engaging wheel coupled to each end of said axle.

4. A toy vehicle comprising:

a chassis having a front end and a rear end;

a flywheel rotatably mounted in said chassis on a vertical axis;

a pinion gear coupled to said flywheel for receiving the output therefrom;

a drive shaft rotatably mounted in said chassis, said drive shaft having a front end and a rear end;

a crown gear coupled to said drive shaft in meshing relationship with said pinion gear;

a first bevel gear coupled to said rear end of said drive shaft;

a second bevel gear coupled to said front end of said drive shaft;

a rear journal box having a front wall, a rear wall, a right sidewall and a left sidewall;

a rear journal bearing provided in each of said walls on said rear journal box;

a front journal box having a front wall, a rear wall, a right sidewall and a left sidewall;

a front journal bearing provided in each of said walls on said front journal box;

a rear axle having a right end and a left end, said rear axle being rotatably mounted in said rear journal box with said right end of said rear axle adjacent said right rear journal bearing and said left end of said rear axle adjacent said left rear journal bearing, said front journal bearing on said rear journal box being rotatably mounted on said drive shaft intermediate said crown gear and said first bevel gear, said rear journal bearing on said rear journal box being rotatably coupled to said rear end of said chassis;

a third bevel gear coupled to said rear axle in meshing relationship with said first bevel gear for receiving an output from said drive shaft;

a front axle having a right end and a left end, said front axle being rotatably mounted in said front journal box with said right end of said front axle adjacent said right front journal bearing and said left end of said front axle adjacent said left front journal bearing, said rear journal bearing on said front journal box being rotatably mounted on said drive shaft intermediate said crown gear and said second bevel gear, said front journal bearing on said front journal box being rotatably coupled to said front end of said chassis;

a fourth bevel gear coupled to said front axle in meshing relationship with said second bevel gear for receiving an output from said drive shaft; and a ground-engaging wheel coupled to each end of each of said rear and front axles.

* * * * *